US005776038A

United States Patent [19]

Hazelwood

[11] Patent Number: 5,776,038

[45] Date of Patent: Jul. 7, 1998

[54] EXERCISE APPARATUS AND ASSOCIATED METHOD

[76] Inventor: Jeff Hazelwood, 218 Glen Dr., Sausalito, Calif. 94965

[21] Appl. No.: 885,038

[22] Filed: Jun. 30, 1997

[51] Int. Cl.[6] ..... A63B 21/06

[52] U.S. Cl. ..... 482/92; 482/97; 482/138; 482/908

[58] Field of Search ..... 482/92–94, 97–103, 482/133, 137, 138, 908

[56] References Cited

U.S. PATENT DOCUMENTS

| | | |
|---|---|---|
| 684,683 | 10/1901 | Herz . |
| 1,166,304 | 12/1915 | Albert . |
| 3,558,130 | 1/1971 | Anderson . |
| 4,336,934 | 6/1982 | Hanagan et al. . |
| 4,834,396 | 5/1989 | Schnell . |
| 4,858,915 | 8/1989 | Szabo . |

FOREIGN PATENT DOCUMENTS

| | | | |
|---|---|---|---|
| 258802 | 3/1988 | European Pat. Off. | 482/97 |
| 242563 | 2/1987 | German Dem. Rep. | 482/97 |

*Primary Examiner*—Richard J. Apley
*Assistant Examiner*—John Mulcahy
*Attorney, Agent, or Firm*—LaMorte & Associates P.C.

[57] ABSTRACT

An exercise apparatus and associate method that provides a variable resistance to muscle movement during the course of a single exercise. The apparatus includes an articulated arm assembly that supports a selected amount of weight plates at one end. The arm assembly is connected to a support frame at a pivot point. The opposite end of the arm assembly is connected to a cable that extends to an exercise attachment that is moved by the user's muscles. As a user exercises, a tensile force is applied to the cable. The tensile force applies a torque to the arm assembly that causes the arm assembly to turn about the pivot point. As the arm assembly moves, the weights are advanced up along an inclined surface. If a strong enough force is applied, the weights can be advanced over the top of the inclined surface. Without the support of the inclined surface, the arm assembly is free to remain extended. In this extended position, the distance between the weight plates and the pivot point is increased, therefore the counter-torque offered by the weights is increased. As a result, the user must apply an increased tensile force to resist the increased counter-torque offered while the weight plates are slowly lowered.

17 Claims, 6 Drawing Sheets

EXERCISE APPARATUS AND ASSOCIATED METHOD

BACKGROUND OF THE INVENTION

1. FIELD OF THE INVENTION

The present invention relates to exercise equipment that provides resistance to the movement of targeted muscles in the body. More particularly, the present invention relates to exercise equipment that is capable of changing the resistance applied to the targeted muscles during the different stages of the exercise cycle.

2. DESCRIPTION OF THE PRIOR ART

The prior art is replete with exercise devices for exercising almost every conceivable muscle group in the body. Many of these prior art devices are convertible between various configurations to enable a person using the device to selectively exercise one of a selected number of muscle groups. Many traditional prior art exercise machines use weights that are affixed to levers or pulleys. The person using the exercise device typically move those weights from up and down using some targeted muscle group. The resistance provided to the muscles by the weights remains constant both while the weights are being lifted up and while the weights are being lowered down. In order to change the resistance provided by the weights, weights must be either added or removed from the device after the exercise is completed.

It would be very advantageous to many different muscle groups if the resistance provided to those muscles during an exercise cycle were to vary at different points in the exercise cycle. In the prior art, a few different types of exercise machines have been developed that vary the resistance offered to a person during an exercise. The common prior art approach to offering varied resistance is through the use of elastic elements and springs. In the prior art, many different types of exercise machines have been developed that use elastic elements or similar spring elements rather than weights to provide resistance to muscles. In many such devices, the resistance of the elastic elements varies as the elastic element is stretched. The problems associated with such prior art devices include the fact that the elastic elements typically elongate over time. As a result, the resistance offered by the elastic elements do not remain constant and the elastic elements must be periodically replaced. Furthermore, fine adjustments in the degree of resistance is often not possible with the use of elastic elements. These disadvantages are not shared by exercise devices that use standard sized weight plates because weight plates do not wear out and the use of weight plates make it very easy to make fine adjustments in the resistance offered by the exercise machine.

In U.S. Pat. No. 4,858,915 to Szabo, entitled WEIGHT BIASED FITNESS MACHINE an exercise machine that uses standard sized weight plates is described where the amount or resistance applied by the machine can be varied while a person exercises. The Szabo exercise machine varies the position of the weight plates along a pivot arm in order to determine the degree of resistance applied against muscle movement. The Szabo device uses ordinary weight plates to supply resistance. As such, a person need not buy specialized elastic elements in order to use the machine. A detriment to the Szabo device is that the position of the weights are controlled by an electric motor. The use of the electric motor and the control circuitry needed to run the electric motor, causes the Szabo machine to be more complex and expensive than many exercise machines without electric components.

A need therefore exists in the art for an exercise machine that uses standard weight plates, is not electric and is capable of applying a changing resistance to a person exercising during the course of the exercise. This need is met by the present invention as described and claimed below.

SUMMARY OF THE INVENTION

The present invention is an exercise apparatus and associate method that provides a variable resistance to muscle movement during the course of a single exercise. The apparatus includes an arm element that supports a selected amount of weight plates at one end. The arm element is connected to a support frame at a pivot point. The opposite end of the arm element is connected to a cable that extends to an engagement element that is moved by the user's muscles. As a user exercises, a tensile force is applied to the cable. The tensile force applies a torque to the arm element that causes the arm element to turn about the pivot point. As the arm element moves, the weights are advanced up along an inclined surface. The higher the weights are advanced up the inclined surface, the greater the force is needed to further advance the weights. If a strong enough force is applied, the weights can be advanced over the top of the inclined surface. Without the support of the inclined surface, the arm element is free to remain extended. In this extended position, the distance between the weight plates and the pivot point is increased, therefore the counter-torque offered by the weights is increased. As the user lowers the weight plates in a controlled manner, the extended arm element further increases the horizontal distance between the weight plates and the pivot point. As a result, the user must apply an increased tensile force to resist the increased counter-torque offered by the slowly lowering weight plates. As the arm element contacts another inclined surface, it is guided to the base of the inclined surface. This causes the arm element to retract, which reduces the distance between the weight plates and the pivot point. The reduced distance and the support offered by the second inclined surface combine to reduce the counter-torque offered by the weight plates. As such, the tensile force which the user must apply is reduced. As the arm element reaches the base of the inclined surface, the exercise cycle is ready to be repeated.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
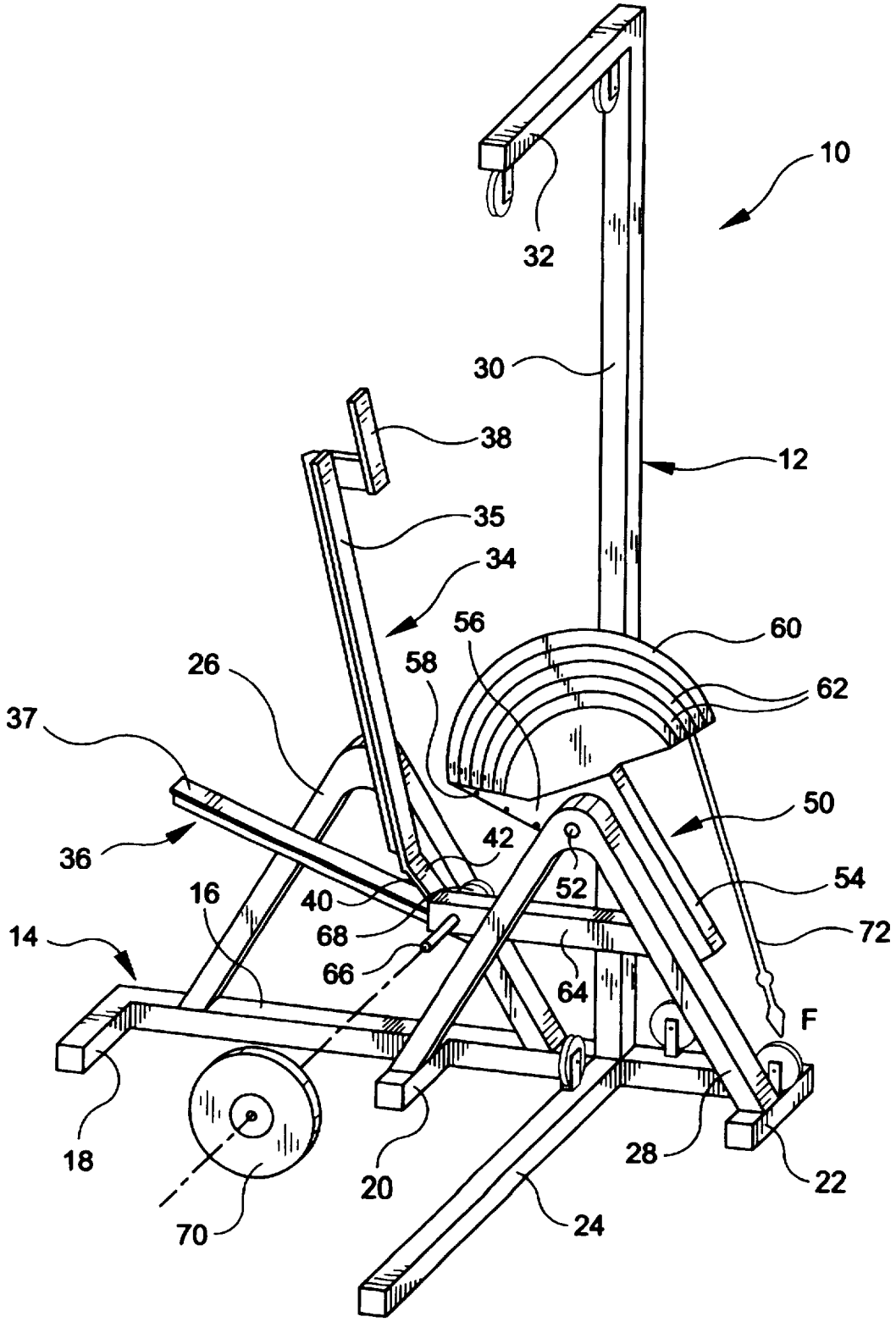
FIG. 1 is a perspective view of one preferred embodiment of an exercise device, in accordance with the present invention, at an initial first point in time in its movement cycle.

Referring to FIG. 1, the frame 12 of the present invention exercise device 10 is shown without the secondary exercise attachments which will later be explained. The frame 12 is used as the primary weight support for several different exercises. As can be seen from FIG. 1, the frame 12 has a base 14 that is configured to sit on a flat surface. The base 14 can have any configuration that makes the frame 12 stable and difficult to topple. In the shown embodiment, the base 14 has a straight, elongated main base element 16 that lays flat on the floor. Three short stabilizing elements 18, 20, 22 intersect the main base element 16 at its two ends and in its center, respectively. A long stabilizing element 24 also is connected to the main base element 16 on the plane of the floor. As will later be explained, the long stabilizing element 24 serves as the support for different attachments that can be added to the frame 12 in order to perform different exercises.

Two brace elements 26, 28 extend upwardly from the base 14 in parallel vertical planes. The first brace element 26 extends upwardly from the main base element 16. The second brace element 28 extends upwardly from two of the short stabilizing elements 20, 22. As a result, the first brace element 26 and the second brace element 28 lie in parallel planes and a predetermined distance separates the two brace elements 26, 28.

The frame 12 also includes a vertical shaft 30 that extends upwardly from the main base element 16 at the same point where the long stabilizing element 24 intersects the main base element 16. As a result, the vertical shaft 30 and the long stabilizing element 24 lay in the same plane. A suspension element 32 extends horizontally from the top of the vertical shaft 30. The suspension element 32 is used to support overhead attachments for overhead exercises, as will later be explained.

Two guide elements 34, 36 are supported by the first brace element 26. The first guide element 34 has a linear top surface 35 that is supported at an angle between 30 degrees and 89 degrees with respect to the horizontal. An optional guide bracket 38 is shown affixed to the first guide element 34 proximate its higher end. The purpose of the optional guide bracket 38 will be later explained.

The second guide element 36 is affixed to the first brace element 26 in the same plane as the first guide element 34. The second guide element 36 has a linear top surface 37 that is oriented at an angle less than 45 degrees with respect to the horizontal. The first guide element 34 and the second guide element 36 are separated by a gap 40 at their point of closest proximity. A flap 42 is pivotably connected to the bottom end of the first guide element 34. The flap 42 extends downwardly and lays across the second guide element 36, thereby creating a type of one way door across the gap 40.

A weight arm assembly 50 is pivotably connected to the frame 12 by a pivot element 52 in between the vertical shaft 30 and the second brace element 28. The weight arm assembly 50 includes rigid arm 54. An angled anchor plate 56 is connected to the rigid arm 54. The anchor plate contains a plurality of anchor holes 58 disposed at different points on the anchor plate 56. A semicircular terraced structure 60 is connected to the rigid arm 54 and the anchor plate 56. The terraced structure 60 contains grooved surfaces 62 at different levels. In the shown embodiment the forward most of the grooved surfaces 62 has the smallest radius of curvature, while the rearward most grooved surface 62 has the largest radius of curvature. The groove surfaces 62 in between the front and the rear have radii of curvature that change incrementally. For each grooved surface 62 on the terraced structure 60, a corresponding anchor hole 58 is present on the anchor plate 56.

A weight support arm 64 is pivotably connected to the end of the rigid arm 54, opposite the terraced structure 60. A support pin 66 extends through the far end of the weight support arm 64. The support pin 66 supports a wheel 68 on one side of the weight support arm 64. The support pin 66 is also used to support a desired number of conventional weight plates 70 on the opposite side of the weight support arm 64.

A cable 72 or a similar flexible element connects to the weight arm assembly 50. Tensile forces are applied to the cable 72 by the performance of different exercises, as will be later explained. The cable 72 terminates with a hook or similar mechanical fastener (not shown) that enables the free end of the cable to connect to one of the anchor holes 58 on the anchor plate 56. The cable 72 then passes over the grooved surface 62 in the terraced structure 60 that corresponds to the anchor hole 58 engaged. For example, if the cable 72 engages the third anchor hole 58 on the anchor plate 56, as is shown, then the cable 72 passes over the third grooved surface 62 in the terraced structure 60. The anchor holes 58 on the anchor plate 56 are placed at different distances from the terraced structure 60. The spacing of the anchor holes 58 compensates for the different radii of curvature on the terraced structure 60. As a result, the effective length of the cable 72 remains constant regardless to in which of the grooved surfaces 62 on the terraced structure 60 that the cable travels. By positioning the cable 72 over different sections of the terraced structure 60, different mechanical advantages can be produced that effect the mount of torque applied by the cable 72 for a give tensile force in the cable 72.

As a force F is applied to the cable 72, a torque is applied to the weight arm assembly 50 that causes the weight arm assembly 50 to turn about a pivot point 52 in a clockwise direction. In its beginning position, the wheel 68 at the end of the weight support arm 64 rests upon the second guide element 36 at a point near the bottom of the second guide element 36. As the torque is applied to the weight arm assembly 50 by the cable 72, then the rigid arm 54 rotates and the weight support arm 64 begins to move.

Figure 2:
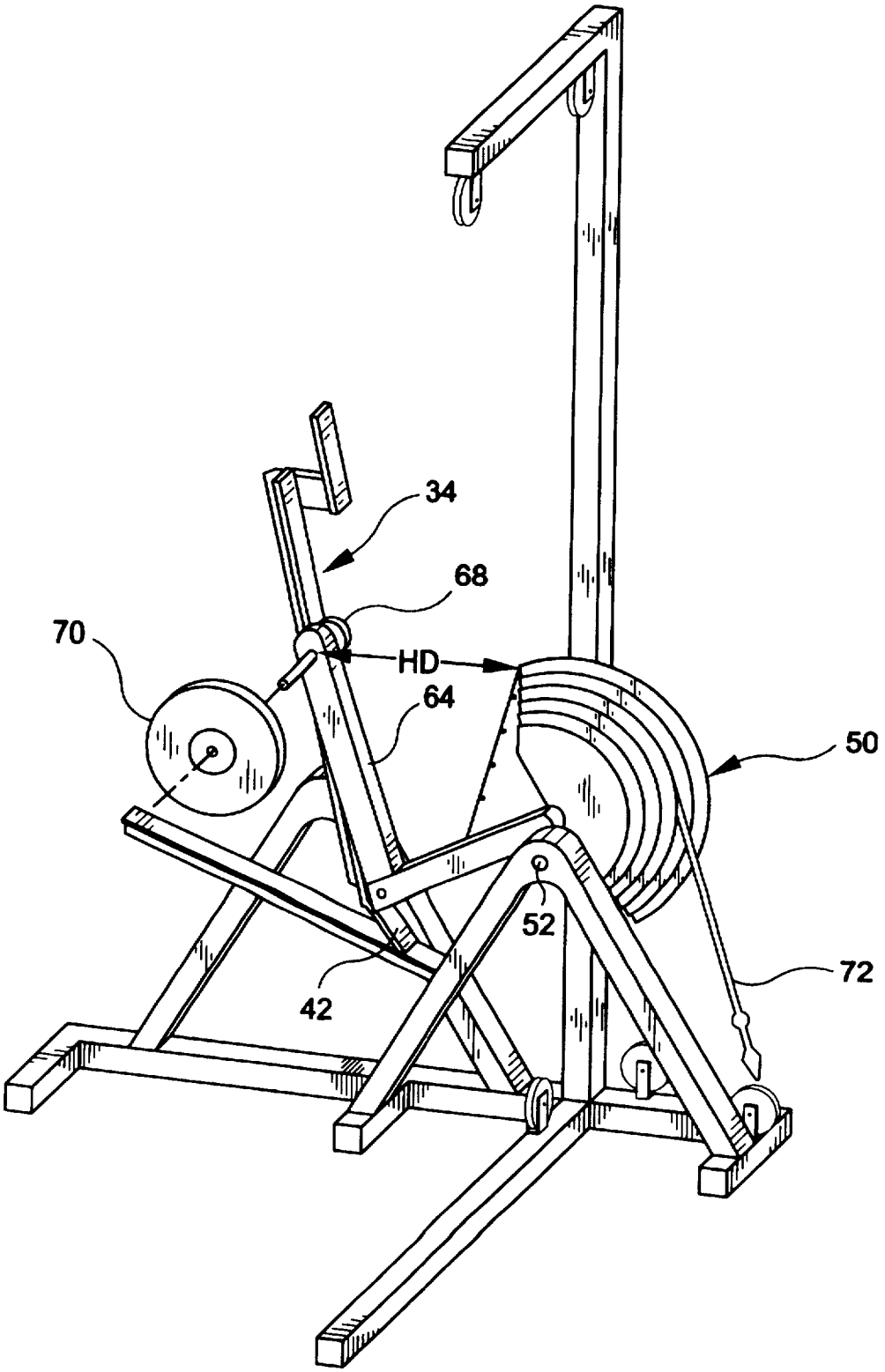
FIG. 2 is a perspective view of the exercise device of FIG. 1 at a later second point in time in its movement cycle.

Referring To FIG. 2, it can be seen that as the weight support arm 64 moves, the wheel 68 rolls up the flap 42 and begins to roll up the first guide element 34. Since the weight support arm 64 is elevated, it is apparent that any weight plates 70 coupled to the weight support arm 64 would also be elevated. The weight plates 70 therefore create a counter torque that acts in the counter clockwise direction. Neglecting the weight of the weight arm assembly 50 itself, the counter torque produced by the weight plates 70 is equal to the product of the normal force (N) of the weight plates 70 times the horizontal distance $H_D$ from the weight plate's center of gravity to the pivot point 52. Where the normal force (N) is the component of the mass of the weight plates 70 that acts in a direction directly against gravity. This is expressed by the formula:

$$\text{Counter Torque}=N(H_D)$$

As the wheel 68 at the end of the weight support arm 64 rolls up the first guide structure 34, the horizontal distance $H_D$ in between the center of gravity of the weight plates 70 and the pivot point 52 increases. Accordingly, it will be understood that the higher the weight plates 70 are moved up the first guide element 34, the greater the counter torque force becomes. As a result, if a person applies a manual force to the cable 72 to move the weight plates 70 up the inclined first guide element 34, that manual force would have to be increased as the weight plates 70 approach the top of the first guide element 34. It will also be understood, that the degree by which the manual force must be increased is a function of the slope of the first guide element 34.

Figure 3:
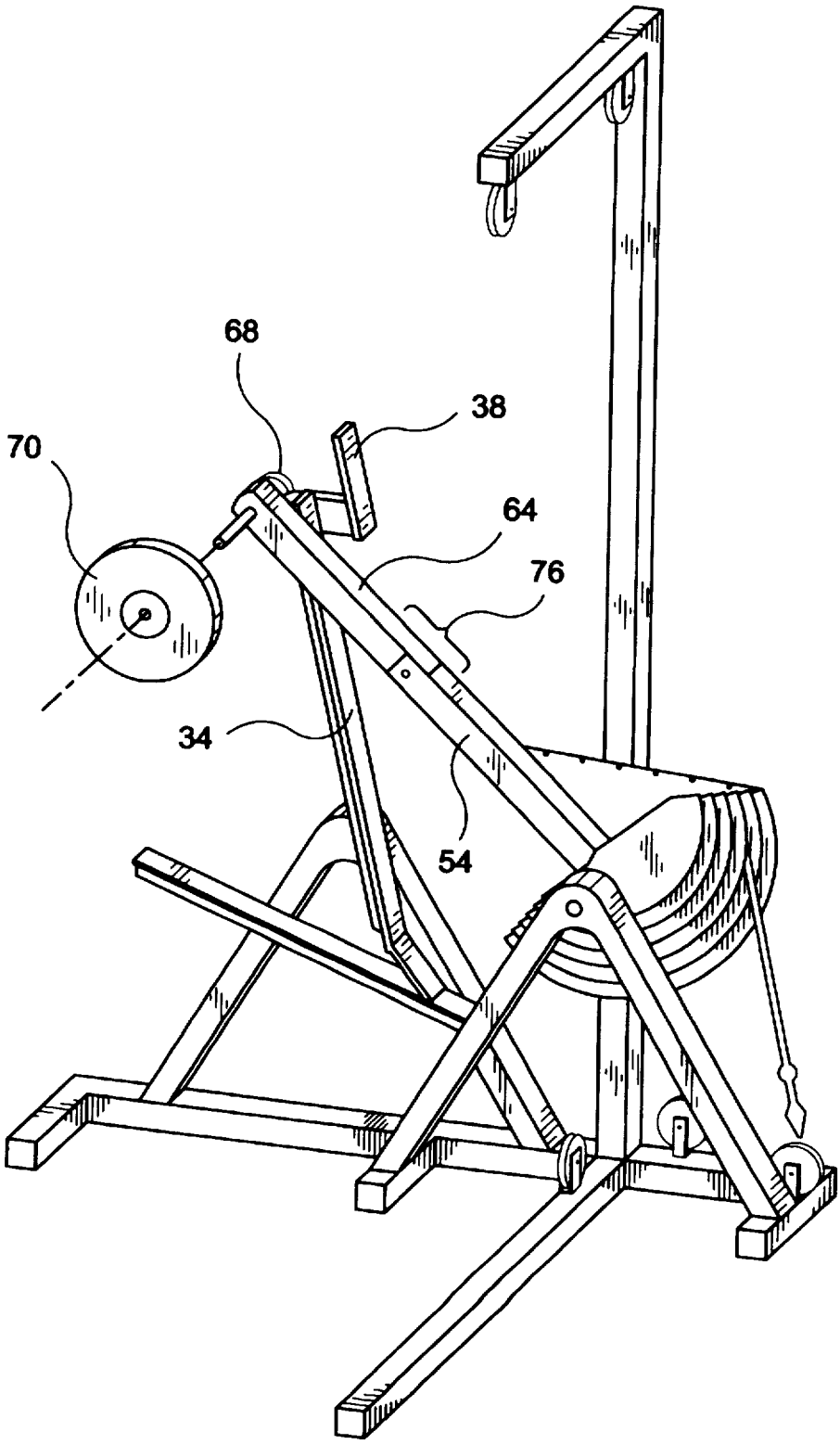
FIG. 3 is a perspective view of the exercise device of FIG. 1 at a later third point in time in its movement cycle.

Referring to FIG. 3, it can be seen that the weight support arm 64 and the rigid arm 54 reach a linear configuration just as the wheel 68 on the weight support arm 64 rolls over the top of the first guide element 34. The joint 76 in between the weight support arm 64 and the rigid arm 54 becomes rigid as the weight support arm 64 and the rigid arm 54 reach a linear configuration. As a result, once the weight plates 70 roll over the top of the first guide element 34, the weight support arm 64 and the rigid arm 54 remain in a linear configuration until the wheel 68 at the end of the weight support arm 64 contacts the below lying second guide element 34.

The guide bracket 38 is present as a safety precaution to ensure that the weight plates 70 roll behind he first guide element 34 and do not fall forward from the first guide element 34.

Figure 4:
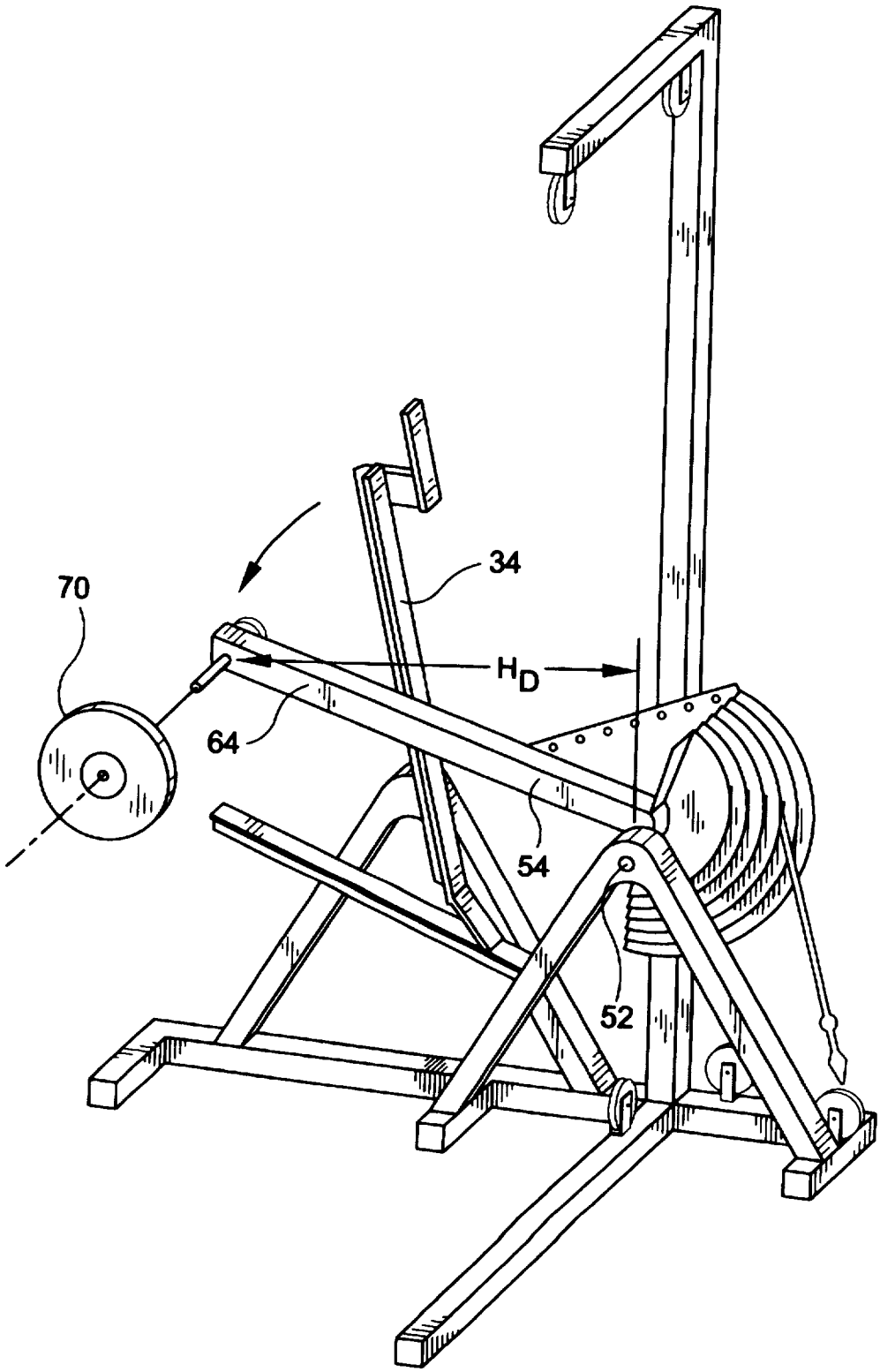
FIG. 4 is a perspective view of the exercise device of FIG. 1 at a later fourth point in time in its movement cycle.

Referring to FIG. 4, it can be seen that as the weight plates 70 roll over the first guide element 34, the weight plates 70 follow an arcuate path downward. As the weight plates 70 follow the arcuate path, the horizontal distance $H_D$ in between the weight plates 70 and the pivot point 52 increases. As a result, the counter torque created by the weight plates 70 also increases. The counter torque increases until the weight support arm 64 and the rigid arm 54 fall to a horizontal orientation. At this orientation, the horizontal distance $H_D$ in between the weight plates 70 and the pivot point 52 is at a maximum.

Figure 5:
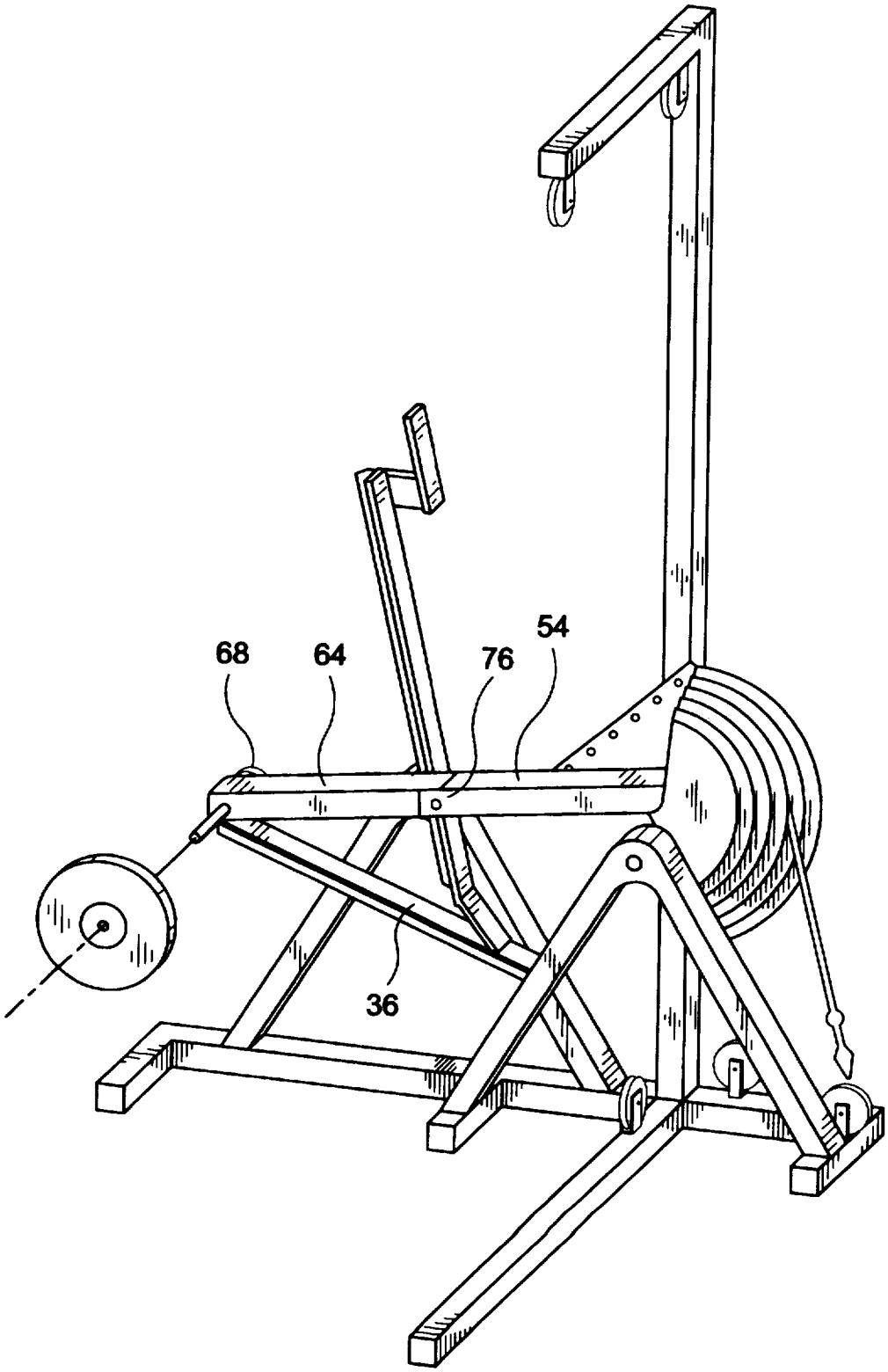
FIG. 5 is a perspective view of the exercise device of FIG. 1 at a later fifth point in time in its movement cycle.

Referring to FIG. 5, it can be seen that just below point the horizontal plane where the counter torque is at a maximum, the wheel 68 at the end of the weight support arm 64 engages the second guide element 36. The wheel 68 rolls down the second guide element 36 causing the joint 76 in between the weight support arm 64 and the rigid arm 54 to bend. Once on the second guide element 36, the counter torque supplied by the weight plates 70 is near zero because nearly the entire mass of the weight plates 70 are supported by the second guide element 36.

Returning to FIG. 1, it can be seen that as the wheel 68 at the end of the weight support arm 64 rolls down the second guide element 36, the wheel 68 passes through the gap 40 and rolls under the flap 42. Once through the gap 40, the flap 42 fall closed behind the wheel 68 and the device is ready for another cycle.

Most exercises require a two stroke control of a muscle group. In the initial stroke muscles are contracted and a force is applied against a resistance. In the reverse stroke, the muscles are slowly relaxed in opposition of the resistance, until the muscles are fully relaxed. This cycle is typically repeated in multiple repetitions.

The exercise device of FIG. 1 is designed to provide resistance to multiple types of two stroke exercises. The exercise device is engaged by a user's body so that during the initial stroke where muscles are contacted, the weight plates 70 are moved completely up the first 20 guide surface 34 to provide the desired resistance. During the reverse stoke, the weight plates 70 fall to the second guide element 36. During that fall, the weight plates 36 supply the needed resistance. As has been explained, the resistance offered by the exercise device 10 increases during the initial stroke and is at a maximum during the reverse stroke. Accordingly, the resistance offered to the muscles during the exercise cycle are varied in manner that improves the effectiveness of the exercise on the muscles being exercised.

Figure 6:
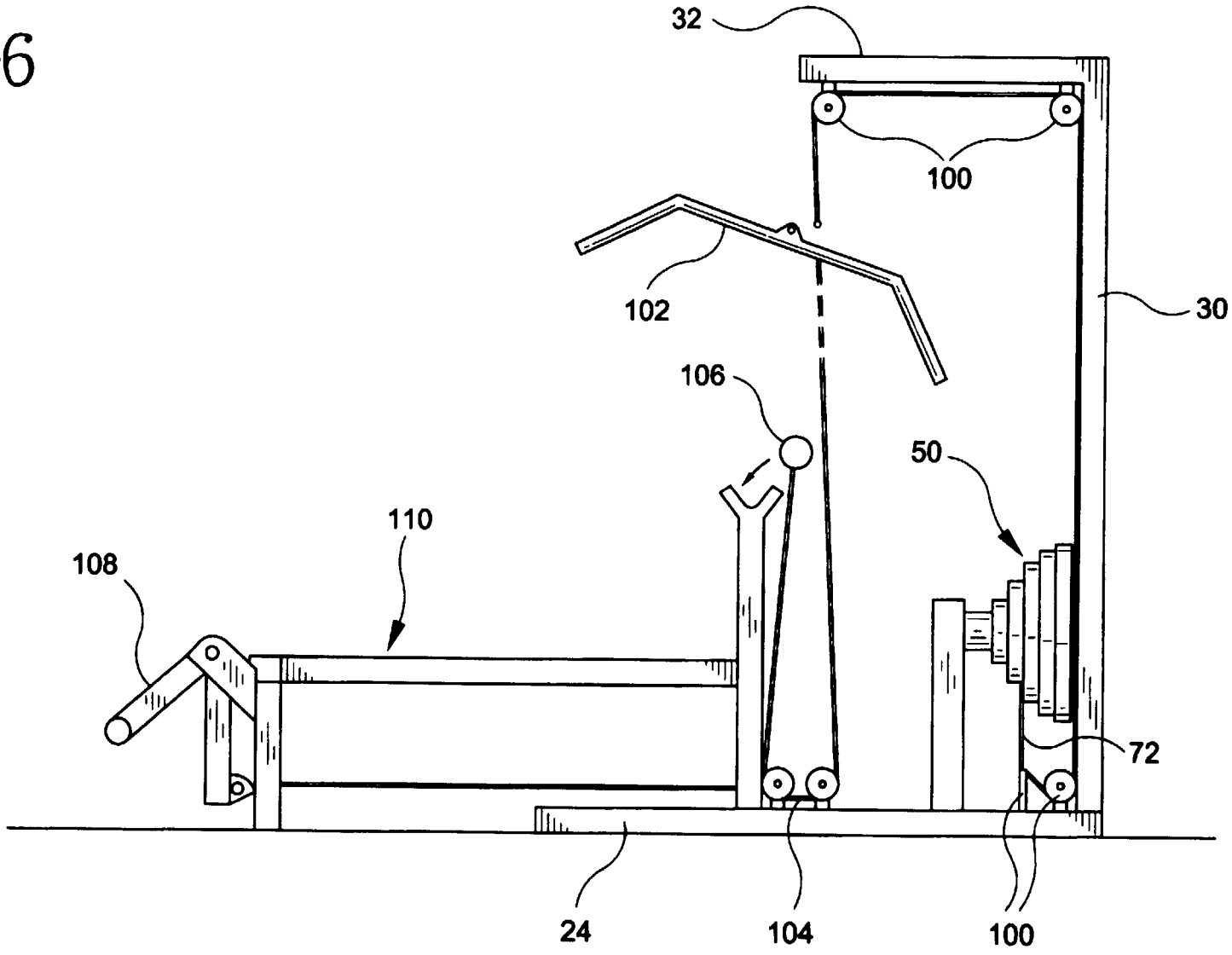
FIG. 6 is a side view of the exercise device of FIG. 1 shown in conjunction with a plurality of different exercise attachments.

Referring to FIG. 6, various pulleys 100 are connected to the frame at different points. The purpose of the pulleys 100 is to direct and orient the cable 72 from the weight arm assembly 50 to an exercise attachment. In FIG. 6, it can be seen that the cable 72 can be attached to the suspension element 32 at the top of the vertical shaft 30. From this suspended location, a pull bar 102 or other such overhead exercise attachment can be connected to the cable 72. Alternatively, the cable 72 can be run from the suspension element to a pulley 104 on the long stabilizing element 24. From this low point, the cable 72 can be connected to a bench bar 106 or a leg curl device 108 on a bench assembly 110. Numerous other exercise attachments can also be adapted for use with the present invention. Any known exercise attachment used in the prior art that is capable of applying tension to the cable 72 is therefore to be considered part of this disclosure.

It will be understood that the embodiments of the present invention described and illustrated herein are merely exemplary and a person skilled in the art can make many variations to the embodiment shown without departing from the scope of the present invention. For example, the cable of the described embodiment can be replaced with a chain and the terraced surface of the described embodiment can be replaced with difference sized sprockets that engage the chain. It should also be understood that the various elements from different embodiments can be mixed together to create alternate embodiments that are not specifically described. All such variations, modifications and alternate embodiments are intended to be included within the scope of the present invention as defined by the appended claims.

What is claimed is:

1. An exercise device for providing a resistance to a muscle group when that muscle group is contracted and relaxed, said device comprising:

an articulated arm assembly having a plurality of arm elements that extend between a first end and a second end;

a frame structure for supporting said arm assembly, wherein said arm assembly is pivotably connected to said frame structure proximate said second end at a pivot point;

a flexible element having a distal end and a proximal end, wherein said distal end of said flexible element is coupled to said arm assembly;

an exercise attachment coupled to said proximal end of said flexible element for engaging said flexible element with a muscle group, wherein said exercise attachment enables the muscle group to move the flexible element in a first direction from a beginning point when the muscle group is contracted and enables the flexible element to return to said beginning point when the muscle group is relaxed;

a first inclined surface having a top end and a bottom end, wherein said inclined surface is coupled to said frame structure;

a second inclined surface: and an engagement element coupled to said arm assembly proximate said first end for engaging said inclined surfaces:

wherein said arm assembly pivots about said pivot point and said engagement element moves up along said first inclined surface and passes over said top end of said inclined surface when said flexible element moves in said first direction and moves down along said second inclined surface when said flexible element moves in said second direction.

2. The device according to claim 1, wherein said engagement element includes a wheel coupled to said first end of said arm assembly, wherein said wheel rides along said first inclined surface and said second inclined surface when said flexible element is moved in said first direction and said second direction, respectively.

3. The device according to claim 1, wherein said arm assembly includes at least one hinged joint disposed in between said first end and said second end, wherein said at least one hinged joint enables said arm assembly to bend as it moves along said first inclined surface and said second inclined surface.

4. The device according to claim 1, further including a weight supporting element disposed proximate said first end of said arm assembly, wherein said weight supporting element enables weight plates to be coupled to said arm assembly.

5. The device according to claim 1, wherein said flexible element applies a predetermined torque to said arm assembly when said flexible element is moved in said first direction with a predetermined force, and said device includes a means for varying said predetermined torque.

6. The device according to claim 1, further including at least one curved surface coupled to said second end of said arm assembly, wherein said flexible element passes along said curved surface at a point in between the distal end and proximal end of the flexible element.

7. The device according to claim 1, further including a terraced structure coupled to said second end of said arm assembly, wherein said terraced structure includes a plurality of different surfaces having a different radius of curvature.

8. The device according to claim 7 further including a plurality of anchor points on said arm assembly to which said flexible element can be selectively attached, one of said anchor points corresponds in location to each os said plurality of different surfaces.

9. The device according to claim 7, wherein said flexible element is a cable and each of said plurality of different surfaces includes a groove that is sized to receive said cable.

10. An exercise device comprising:

an articulated arm assembly having a plurality of arm elements extending between a first end and a second end, wherein said second end of said arm assembly is pivotably connected to a support at a pivot point;

an inclined surface having a top end;

an engagement element coupled to said first end of said arm assembly for engaging said inclined surface:

a cable coupled to said second end of said arm assembly, wherein a force applied to said cable creates a torque on said arm assembly, thereby causing said arm assembly to move about said pivot point and causing said engagement element to move up said inclined surface, wherein a force applied to said cable in excess of a predetermined threshold causes said engagement element to pass over said top end of said inclined surface; and a mechanism coupled to said cable for manually applying a force to said cable using a selected muscle group.

11. The device according to claim 10, wherein said engagement element includes a wheel that rides along said inclined surface when said arm assembly moves past said inclined surface.

12. The device according to claim 10, wherein said arm assembly includes at least one hinged joint disposed in between said first end and said second end, wherein said at least one hinged joint enables said arm assembly to bend as said engagement element moves along said inclined surface.

13. The device according to claim 10, further including a weight supporting element disposed proximate said first end of said arm assembly, wherein said weight supporting element enables weight plates to be coupled to said arm assembly.

14. The device according to claim 10, wherein said arm assembly moves from an initial position when a force is first applied to said cable, and said arm assembly automatically returns to said initial position when said force is removed.

15. The device according to claim 14, further including a guide for returning said arm assembly to said initial position after a force in excess of said predetermined threshold has been applied to said cable.

16. A method of applying a varying force resistance to a component of a piece of exercising equipment, wherein the component is moved from an initial position to an advanced position by a user's muscles, said method comprising the steps of:

coupling said component to a cable, whereby the movement of said component to said advanced position applies a tensile force to said cable;

providing an articulated arm assembly containing a plurality of arm elements that extend between a first end and a second end, wherein said second end of said arm assembly is pivotably coupled to a support at a pivot point;

providing an inclined surface adjacent said arm assembly;

providing a means at said first end of said arm assembly for engaging said inclined surface:

providing a means for resisting movement of said arm assembly:

coupling said cable to said arm assembly wherein a tensile force applied to said cable causes said second end of said arm assembly to turn around said pivot point and causing said engaging means to travel up said inclined surface whereby an effective length of the arm assembly changes, thus applying a varying resistance force to said cable, and a force applied to said cable in excess of a predetermined threshold causes said engaging means to pass over a top end of said inclined surface.

17. The method according to claim 16, wherein said inclined surface has a top surface and said method further includes having said engaging means extend over said top end of said inclined surface when said component is at said advanced position.

* * * * *